US006595356B1

(12) United States Patent
Homoly

(10) Patent No.: US 6,595,356 B1
(45) Date of Patent: Jul. 22, 2003

(54) GOLF CLUB TRANSPORT CASE

(75) Inventor: Casey J. Homoly, Dallas County, TX (US)

(73) Assignee: Case Cargo Incorporated, Dallas, TX (US)

( * ) Notice: Subject to any disclaimer, the term of this patent is extended or adjusted under 35 U.S.C. 154(b) by 0 days.

(21) Appl. No.: 10/142,344

(22) Filed: May 10, 2002

(51) Int. Cl.[7] ..... A63B 55/00; A63B 55/04; A63B 55/08

(52) U.S. Cl. ..... 206/315.3; 206/315.4; 206/315.7; 70/58; 248/96; 280/DIG. 6

(58) Field of Search ..... 206/315.3, 315.4, 206/315.7, 315.8; 280/DIG. 6; 248/96; 70/58

(56) References Cited

U.S. PATENT DOCUMENTS 1,414,875 A * 5/1922 Hanaford ..... 206/315.3
1,452,084 A * 4/1923 Luckett ..... 206/315.7
1,908,998 A * 5/1933 Mullins ..... 206/325.4
3,532,313 A * 10/1970 Brayton ..... 248/96
4,522,299 A * 6/1985 Clark et al. ..... 206/315.3
4,643,302 A * 2/1987 Baumgardner ..... 206/315.3 X
4,648,612 A * 3/1987 Park ..... 280/DIG. 6 X
4,726,597 A * 2/1988 Hickin ..... 280/DIG. 6 X
4,767,001 A * 8/1988 Kim ..... 206/315.3
4,782,948 A * 11/1988 Weisse ..... 206/215.7
5,112,068 A * 5/1992 Liao et al. ..... 206/315.3 X
5,450,955 A * 9/1995 Olson ..... 206/315.7 X
5,860,519 A * 1/1999 Meyer et al. ..... 206/315.3
5,934,624 A * 8/1999 Suk ..... 206/315.7 X
6,112,895 A * 9/2000 Ryan ..... 206/315.3 X
6,152,343 A * 11/2000 Shin ..... 224/645
6,161,692 A * 12/2000 Lizarraga ..... 206/315.3
6,460,867 B2 * 10/2002 Sciulli ..... 280/DIG. 6 X

* cited by examiner

*Primary Examiner*—Sue A. Weaver
(74) *Attorney, Agent, or Firm*—Jack A. Kanz

(57) ABSTRACT

A lightweight rigid container suitable for trans-shipment of golf clubs is formed by two tubular bodies, each having a closed end and an open end. The open ends are adapted to telescopically overlap to form a rigid hollow enclosure. The two bodies are secured together by a locking structure which extends diametrically through the overlapped ends. Carry straps and handles are secured to one of the tubular bodies so that it may be used as a club carry bag on the golf course. Feet and wheels are removeably attached to the container body.

16 Claims, 3 Drawing Sheets

GOLF CLUB TRANSPORT CASE

This invention relates to transport bags and cases for sports equipment such as golf clubs and the like. More particularly, it relates to transport cases which are sufficiently light and compact to use as club carrying bags on a golf course during play and sufficiently rigid and secure to use as shipping containers which protect the equipment contained therein during shipment as baggage, freight or the like.

Golfers who prefer to use their own personal clubs when playing courses remote from the golfer's residence face the problem of transporting their golf clubs and paraphernalia from home to golf course without loss or damage to the golf clubs. Various transport cases for golf clubs are widely used. However, most are large and cumbersome and present difficulties in shipment, particularly when shipped as baggage on commercial airlines.

When used to ship golf clubs as baggage or freight, the trans-shipment case must be sufficiently rigid to prevent damage to the clubs and the container closure must be sufficiently secure to prevent pilfering of the equipment contained therein. Conventional trans-shipment cases used for this purpose are much too heavy and bulky to carry around a golf course, so the golfer must also ship a club carrying bag for use on the course. Accordingly, most hard-sided trans-shipment cases are designed to accommodate a carrying bag as well as the golf clubs, making the trans-shipment case even larger, heavier and bulkier.

Some golfers forego the security of a hard-sided trans-shipment case and use a soft-sided bag, such as a canvas bag or the like, to contain the carry bag and clubs during shipment. Such soft-sided bags, however, offer little protection against handling damage and no protection against pilfering. Accordingly, a transport case which provides protection and security during shipment and which is sufficiently light and compact to use during course play would be highly desireable.

In accordance with the present invention, a transport case for golf clubs is provided which is sufficiently rigid and secure to use as a trans-shipment case. The case is sufficiently large to contain a full set of golf clubs and provided with a tamper-proof closure which is locked in place to prevent unauthorized entry into or removal of anything from the interior of the case. The transport case of the invention, however, is sufficiently light and compact to be used as a carry bag during play and may employ removeable feet which assist in holding the case upright or a removeable collapsible stand which supports the case in the conventional tilted position. Detachable wheels may also be provided which permit the case to be dragged in the manner of conventional trolley luggage. The feet, wheels, support stand, etc., are all removeably attached to the case so that they may be conveniently removed from the case and stored in pockets or compartments inside or carried on the case during shipment. The case of the invention therefore provides the strength and security of a hard-sided trans-shipment case and the lightweight compactness and convenience of a carry bag in a single unit which may be used for both shipping and play. Other features and advantages of the invention will become more readily understood from the following detailed description taken in connection with the appended claims and attached drawing in which:

Figure 1:
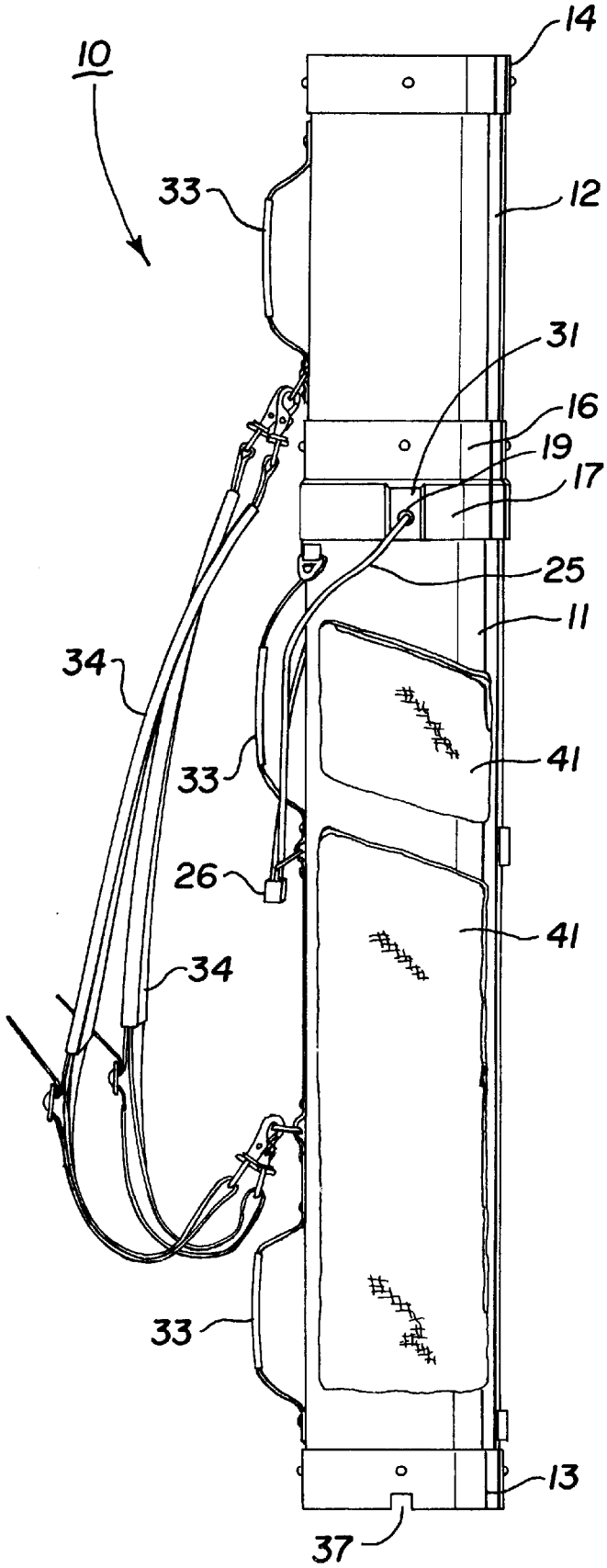
FIG. 1 is a side elevational view of a golf club transport case made in accordance with the invention.

The drawing is incorporated into and forms part of the disclosure of this specification to illustrate exemplary embodiments of the invention. Throughout the several views of drawing like reference numerals designate corresponding elements. The figures are not to scale but are intended to disclose the inventive concepts by illustration. It will be recognized that the principles of the invention may be utilized and embodied in many and various forms. In order to demonstrate these principles, the invention is described herein by reference to specific preferred embodiments. The invention, however, is not limited to the forms illustrated and described. Furthermore, the invention is not limited to use in connection with transport of golf clubs but may find utility in other similar applications.

For purposes of this disclosure, the term "wheels" is used to mean any rolling structure such as castors, trolleys, rollers, captured balls and the like. Similarly, "case" and "bag" are used interchangeably to mean any structure used as a container to transport sports equipment such as golf clubs and the like and "tubular" is used to refer to any elongated hollow structure wherein the cross-sectional configuration is circular, retangular, oval or any other shape.

In FIG. 1 the invention is illustrated as a case 10 comprised of a first body 11 and a second body 12 assembled to provide an elongated hollow case 10. In the preferred embodiment, first body 11 and second body 12 are sections of polyvinylchloride tubing having an internal diameter of approximately fifteen (15) cm. Other suitable materials and 'shapes, however, will perform satisfactorily.

The bottom end of first body 11 and the top end of second body 12 are permanently enclosed and sealed with end caps 13 and 14, respectively. The top (open) end of first body 11 is fitted with a collar 15 permanently secured to the first body 11. The bottom (open) end of the second body 12 is fitted with a collar 16 permanently secured to the second body 12. Collar 16 carries a skirt 17 projecting coaxially therewith. The internal diameter and configuration of skirt 17 is complementary with the external diameter and configuration of collar 15 so that skirt 17 may be telescoped over collar 15. When so assembled, collar 15 mates snugly within skirt 17 to form a rigid connection and second body 12 forms a secure trans-shipment closure for the case 10. To provide further axial rigidity, a curved shield 18 having an external diameter matching the internal diameter of the first body 11 and the second body 12 may be secured within the first body 11 to project into the second body 12 (as seen more clearly in FIG. 7).

When the first body 11 and the second body 12 are mated together with the skirt 17 defining the lower end of second body 12 overlapping the collar 15 defining the upper end of first body 11, the first body 11 and second body 12 form a rigid hollow case 10. To securely maintain the two bodies 11, 12 locked together, a keyway which extends through the overlapped ends is provided through which a locking mechanism may be extended. In the preferred embodiment, the keyway comprises a set of holes 19 in diametrically opposed sides of skirt 17 which are aligned with holes 20 in diametrically opposed sides of the collar 15. When a suitable locking mechanism is mounted in the keyway, the second body 12 comprises a trans-shipment security closure rigidly locked to first body 12 to provide a rigid, secure case 10.

Figure 4:
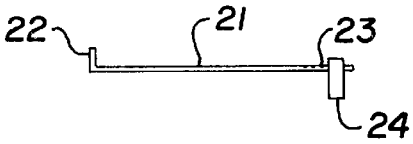
FIG. 4 is a pictorial illustration of a security pin which may be used to secure the trans-shipment closure to the case body.

In the preferred embodiment a pin 21 as shown in FIG. 4 is used as the locking mechanism. Pin 21 comprises an elongated body adapted to extend through the keyway defined by holes 19, 20. One end of pin 21 is provided with an enlargement or hook 22 of such size and shape to prevent that end from entering the keyway. The opposite end of pin 21 extends from the opposite side of case 10 and is provided with holes, teeth, ridges, grooves 23 or the like which mate with a suitable lock 24 to prevent unauthorized extraction of pin 21 from the keyway.

Figure 3:
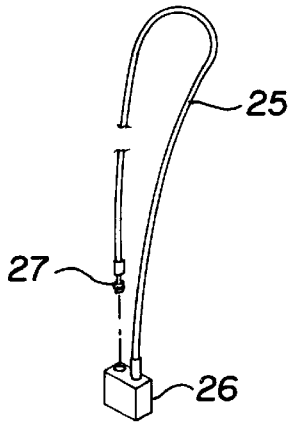
FIG. 3 is a pictorial illustration of a security cable lock which may be used to secure the trans-shipment closure to the case body as shown in FIG. 1.

Alternatively, the locking mechanism may be in the form of a security cable 25 such as shown in FIG. 3. One end of cable 25 is permanently secured to the body of a lock 26 adapted to releasably secure the opposite end 27 within lock body 26. Opposite end 27 is shaped and sized to pass through the keyway. Cable 25 is sufficiently long to extend from lock body 26, through the keyway defined by the diameter of case 10, and back to lock body 26. If desired, additional items may be securely attached to the case 10 with security cable 25.

If desired, a tube (not shown) may be secured inside first body 11 to extend between holes 20 and define a channel connecting holes 20 for guiding insertion of the locking mechanism (such as pin 21 or cable 25) through the keyway. The tube (not shown) may also act as a divider to separate golf clubs 40 and/or a handle for lifting first body 11 when the security closure defined by second body 12 is removed.

To further stabilize the connection between the overlapped ends of first body 11 and the second body 12, the overlapping portions (skirt 17 and collar 15 in the embodiment illustrated) may be provided with bosses 30 (see FIG. 7) in one of the end pieces which mate with grooves 31 in the other end piece. The boss 30 and groove 31 arrangement not only reinforces the interconnection, it assists in ready alignment of holes 19, 20 to form and define the locking keyway. Bosses 30 and groves 31 may be tapered and/or slanted to form a snug interference connection and may, of course, take other shapes such as pins mating with slots, mating threads or other similar structures which aid in forming a secure connection between the bodies 11 and 12. If desired, all or part of the interior of case 10 may be lined and/or padded to protect the clubs 40 and guides or racks (not shown) may be appropriately positioned within the case 10 to support and arrange the clubs 40 as desired. When the trans-shipment security closure defined by second body 12 is secured to first body 11 to form case 10 as described hereinabove, the case 10 provides an excellent rigid and secure container for shipment of golf clubs and the like without concern for shipping damage or pilferage. The case 10 may be provided with carrying handles 33 and/or detachable shoulder straps 34 for conveniently carrying the case 10.

Figure 6:
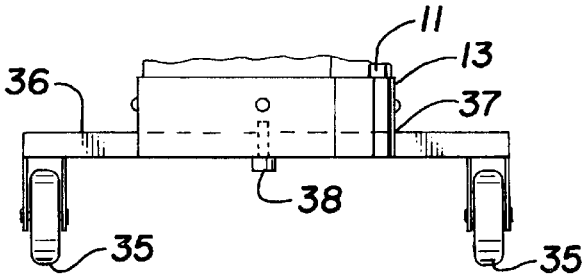
FIG. 6 is an elevational view of the lower end of the case of FIG. 1 illustrating placement and attachment of removeable wheels.

To further aid in transporting the case 10, wheels may be attached adjacent the closed end of first body 11 so that the case 10 may be tilted and dragged on the wheels as in conventional trolley luggage. In the preferred embodiment, wheels 35 are supported at opposite ends of an elongated frame 36 which is adapted to fit within a slot 37 in bottom face of bottom end cap 13. Frame 36 preferably defines a centrally located aperture which is aligned with a threaded stud projecting from stud projecting from end cap 13 or a threaded socket in end cap 13. As illustrated in FIG. 6, frame 36 is positioned in slot 37 and removeably secured to end cap 13 with a thumb screw 38. Wheels 35 may thus be attached to case 10 when needed but readily and easily removed and stored when not use.

Figure 2:
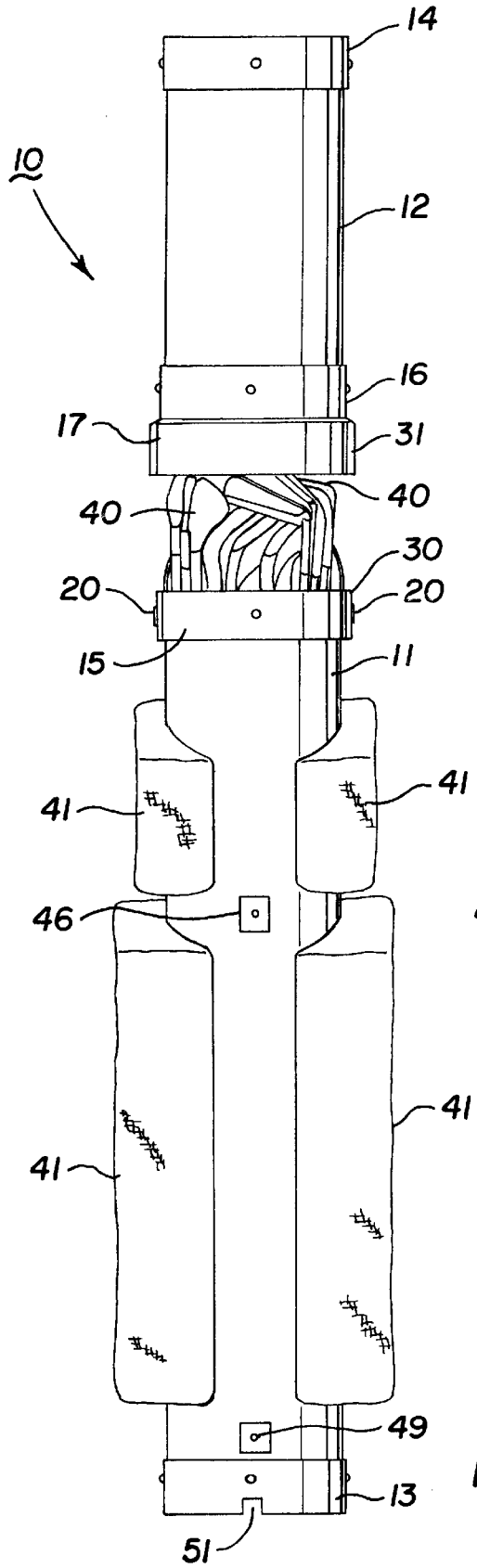
FIG. 2 is a front elevational view of the case of FIG. 1 illustrating removal of the security and trans-shipment closure.

The case 10 is not only a rigid and secure shipping case, it is also sufficiently lightweight and compact to be used as a club carry bag on the golf course. In order to be conveniently used as a carry bag, the first body 11 should be sufficiently deep to accommodate the shafts of the golf clubs with the heads projecting therefrom as shown in FIG. 2. To accommodate clubs of different lengths, the second body 12 should be about one-third to about one-half as long as first body 11. With the security closure defined by second body 12 removed, clubs 40 are carried and presented ready for use in the carry bag defined by first body 11. As with conventional carry bags, first body 11 (as well as second body 12) may be provided with soft-sided (or hard-sided) recloseable pockets 41 for storing sports paraphernalia such as gloves, tees, balls, etc. Furthermore, the structure of frame 36 and wheels 35 is sufficiently small and appropriately shaped to be conveniently stored in pockets 41 when not in use.

Figure 7:
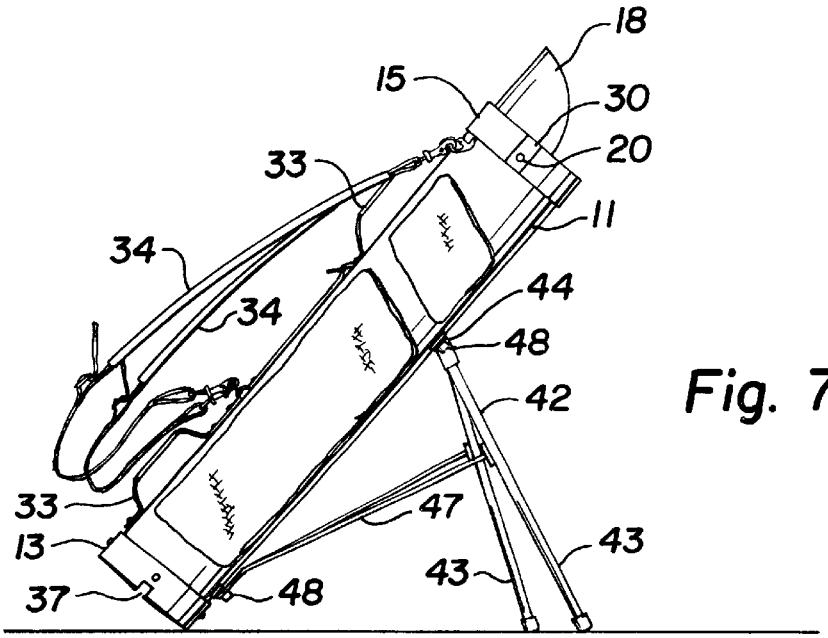
FIG. 7 is a side elevational view of the case of FIG. 1 with the trans-shipment closure removed and a removeable collapsible or retractable stand attached to support the case in the conventional inclined position.

When first body 11 is used on the golf course as a club carry bag, it may be fitted with a stand 42 including retractable legs 43 which cooperate with the closed end of first body 11 to define a tripod to support the first body 11 in an inclined position as illustrated in FIG. 7. In the preferred embodiment, stand 42 comprises a base 44 which supports legs 43 and which is removeably attached to first body 11 on a side thereof at a point which is a substantial distance from the bottom end cap 13. The base 44 is preferably attached to first body 11 by a thumb screw 48 or the like which passes through the base 44 and engages a mating threaded socket 46 on or in the side of first body 11. Stand 42 also includes spring-loaded or collapsible bracing structure 47 which is secured to legs 43 and removeably attachable to first body 11 with a similar thumb screw 48 which mates with a second threaded socket 49 on or in the side of first body 11 at or near the closed end thereof. Alternative means, such as interlocking latches, tongue and groove arrangements, slotted connectors and the like, may be used to removeably attach stand 42 to first body 11.

Whatever attachment means is employed, it should permit quick and easy attachment and detachment by hand without use of tools. When the stand 42 is attached, it may be deployed as shown in FIG. 7 to support the first body 11 in an inclined position presenting the club heads for selection and use. The first body 11 may be carried about the golf course by handles 33 or support straps 34 and the legs 43 of stand 42 deployed as required to present the clubs 40 to the user. The stand 42, however, may be easily removed and stored in one of the pockets 41 for shipment.

Figure 5:
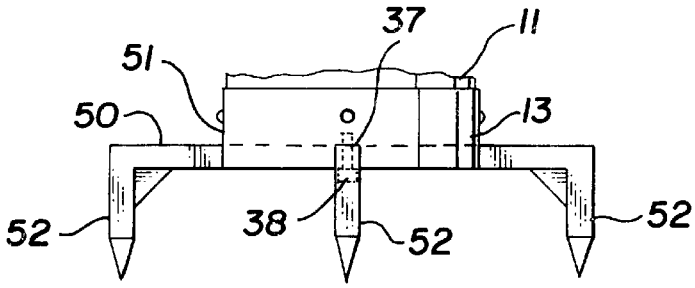
FIG. 5 is an elevational view of the lower end of the case of FIG. 1 illustrating placement and attachment of removeable feet.

An alternative stand arrangement is illustrated in FIG. 5. The alternative stand arrangement comprises a support foot secured to the closed end of first body 11 which supports and aligns first body 11 substantially vertically. In the embodiment illustrated, the foot comprises a pair of elongated beams 50, each having a length greater than the diameter of the first body 11. One beam 50 is secured in slot 37 as described hereinabove with respect to frame 36. The other beam is secured in a second slot 51 (transverse to slot 37) so that the beams 50 span the diameter at substantially right angles to each other and extend outwardly from the bottom face of bottom end cap 13 a sufficient distance to stabilize and support the first body in an upright substantially vertical orientation.

To improve stability of the foot formed by beams 50, stakes 52 extend from the ends of beams 50 substantially parallel with the central axis of first body 11. The stakes 52 are pointed in the direction away from the closed end of first body 11 and thus may be used to pierce the surface of the golf course turf to stabilize the first body 11 in the upright orientation. As with the wheel frame 36, the foot beams 50 may be readily removed and stored in pockets 41 when not in use.

With the tubular case formed of rigid material such as polyvinylchloride tubing or the like, the case 10 (with feet, wheels, stand, etc., removed) may be used as a secure shipping container which protects the contents from handling damage and pilfering. Since the first body 11 is sufficiently light and compact, it may be used as a club carry bag. Thus the case of the invention combines the advantages of a trans-shipment case and a carry bag in a single unit.

While the invention is primarily designed to provide a trans-shipment and carrying case for golf clubs, it will be apparent from the foregoing that the principles of the invention may find utility in other applications. It is to be understood, therefore, that even though numerous characteristics and advantages of the invention have been set forth in the foregoing description together with details of the structure and function of the invention, this disclosure is to be considered illustrative only. Various changes and modifications may be made in detail, especially in matters of shape, size, arrangement and combination of parts, without departing from the spirit and scope of the invention as defined by the appended claims.

What is claimed:

1. A golf club transport case comprising:

(a) a first elongated tubular body having substantially rigid sidewalls, a closed end and an open end;

(b) a second elongated tubular body having substantially rigid sidewalls, a closed end and an open end adapted to mate with and overlap the open end of said first tubular body to define an enclosed tubular body;

(c) a keyway extending diametrically through the overlapped ends of said first body and said second body; and (d) means extending through said keyway to secure said first body to said second body.

2. A golf club transport case as defined in claim 1 wherein said keyway is a set of holes in the overlapped portions of said first body and said second body aligned to define a path through the diameter of the enclosed tubular body.

3. A golf club transport case as defined in claim 1 wherein said means extending through said keyway is a flexible cable having first and second ends, at least one of which is sized to extend through said keyway, which may be detachably secured together to prevent removal of said cable from said keyway and thereby prevent separation of said first body and said second body.

4. A golf club transport case as defined in claim 1 wherein said means extending through said keyway is a pin having first and second ends, one of which is sized to prevent passage thereof through said keyway and the other of which is adapted to be removeably secured to a lock which prevents removal of said pin from said keyway.

5. A golf club transport case as defined in claim 1 wherein said overlapped ends include mating structures which align said first body and said second body with respect to said keyway and prevent rotation of said first body with respect to said second body.

6. A golf club transport case as defined in claim 1 including retractable legs removeably secured to said first body which cooperate with said closed end of said first body to support said first body in an inclined position.

7. A golf club transport case as defined in claim 1 including wheels removeably attached to said first body adjacent said closed end.

8. A golf club transport case as defined in claim 7 wherein said wheels are supported on an elongated frame extending substantially diametrically across said closed end of said first body and which is removeably secured to said closed end.

9. A golf club transport case as defined in claim 1 including a support foot removeably secured to the closed end of said first body which supports said first body substantially vertically.

10. A golf club transport case as defined in claim 9 wherein said support foot comprises at least two elongated beams, each having a length greater than the diameter of said first body, arranged to extend across the diameter of the said closed end at substantially right angles to each other.

11. A golf club transport case as defined in claim 10 wherein at least one of said beams includes a stake extending from one end thereof substantially parallel with the central axis of said first tubular body and pointing in the direction away from said closed end.

12. A golf club transport case as defined in claim 1 including recloseable pockets secured to said first tubular body.

13. A golf club transport case as defined in claim 1 wherein the axial length of said second tubular body is approximately one-half to approximately one-third the axial length of said first tubular body.

14. A golf club transport case as defined in claim 1 wherein the central portions of first elongated body and said second elongated body are polyvinylchloride tubing having an internal diameter of about fifteen (15) cm.

15. A golf club bag comprising:

(a) a rigid, elongated tubular body having an open upper end and a closed lower end;

(b) carry straps removeably attached to the outer surface of said tubular body;

(c) a slot in the face of said closed lower end; and (d) a foot removeably secured to said closed lower end comprising at least two elongated beams, each having a length greater than the diameter of said tubular body, extending diametrically across said enclosed lower end with at least one of said beams fitted within said slot.

16. A golf club bag as defined in claim 15 wherein a stake extends from at least one end of one of said beams in a direction substantially parallel with the central axis of said tubular body in the direction away from said enclosed lower end.

* * * * *

UNITED STATES PATENT AND TRADEMARK OFFICE

CERTIFICATE OF CORRECTION

PATENT NO. : 6,595,356 B1
DATED : July 22, 2003
INVENTOR(S) : Casey J. Homoly

It is certified that error appears in the above-identified patent and that said Letters Patent is hereby corrected as shown below:

Column 4,
Line 4, should read -- stud projection from end cap 13 or a --

Signed and Sealed this

Fourteenth Day of October, 2003

JAMES E. ROGAN
*Director of the United States Patent and Trademark Office*